US005638767A

United States Patent [19]

Bush

[11] Patent Number: 5,638,767

[45] Date of Patent: Jun. 17, 1997

[54] HANDHELD WARNING DEVICE

[76] Inventor: Irving M. Bush, 3811 Ocean Front Walk, Marina del Rey, Calif. 90292

[21] Appl. No.: 373,431

[22] Filed: Jan. 17, 1995

[51] Int. Cl.[6] ..... G08B 3/00; G10K 5/00; A63B 71/14

[52] U.S. Cl. ..... 116/139; 116/DIG. 44

[58] Field of Search ..... 2/16, 20, 159, 2/160, 161.1, 910; 116/67 R, 139, 142 FP, DIG. 44; 446/26, 213

[56] References Cited

U.S. PATENT DOCUMENTS

| | | | |
|---|---|---|---|
| 1,686,233 | 10/1928 | Halliday | 116/DIG. 44 |
| 2,398,951 | 8/1968 | Disko | 2/20 |
| 3,027,794 | 4/1962 | Chute | 84/406 |
| 3,496,573 | 2/1970 | Kuchar et al. | 2/16 X |
| 3,638,011 | 1/1972 | Bain et al. | 240/6.4 W |
| 3,774,572 | 11/1973 | Borraccio | 116/67 R |
| 3,778,053 | 12/1973 | Smith, III et al. | 446/213 X |
| 3,823,616 | 7/1974 | Houseman et al. | 74/471 |
| 3,941,081 | 3/1976 | Nakamura | 116/142 FP |
| 4,183,100 | 1/1980 | De Marco | 2/159 |
| 4,459,992 | 7/1984 | Gwyn | 128/687 |
| 4,504,980 | 3/1985 | Butcher | 2/160 |
| 4,635,516 | 1/1987 | Giannini | 84/1.01 |
| 5,032,824 | 7/1991 | Corbin | 340/574 |
| 5,075,671 | 12/1991 | Livingston, III | 340/574 |
| 5,088,121 | 2/1992 | Wallace | 2/160 |
| 5,168,576 | 12/1992 | Krent et al. | 2/2 |
| 5,253,882 | 10/1993 | Mitchell | 280/11.2 |
| 5,257,418 | 11/1993 | Jaskiewicz | 2/910 X |
| 5,262,757 | 11/1993 | Hansen | 340/427 |
| 5,500,956 | 3/1996 | Schulkin et al. | 2/161.1 |

FOREIGN PATENT DOCUMENTS

| | | | |
|---|---|---|---|
| 641352 | 4/1928 | France | 116/139 |
| 315084 | 10/1919 | Germany | 116/139 |
| 53460 | 9/1910 | Switzerland | 446/26 |

*Primary Examiner*—William A. Cuchlinski, Jr.
*Assistant Examiner*—Willie Morris Worth
*Attorney, Agent, or Firm*—Cislo & Thomas

[57] ABSTRACT

A handheld device used by skaters and the like for warning pedestrian traffic comprises an air bladder attached to a strap that is secured to the palm of the hand in such a way that when the user simply squeezes the bladder firmly, a loud honking sound is emitted. The sound is created by air passing through a disk containing a small vibrating reed that is housed on the posterior side of the air bladder. Additionally, the handheld warning device may incorporate a palm protection pad to minimize injury to the hand in the event that the skater falls down.

9 Claims, 6 Drawing Sheets

HANDHELD WARNING DEVICE

BACKGROUND OF THE INVENTION

This invention generally relates to audible warning devices for use by roller bladers, roller skaters, skate boarders and the like. More particularly, this invention relates to a simple mechanical device which when held in a user's hand produces an anti-collision warning sound.

Typically, roller blading, roller skating and skate boarding are activities that are often practiced on sidewalks, boardwalks, along beaches, streets and other areas where pedestrian traffic is present. Because of the presence of many people, often unaware of the faster moving skaters, the danger of collision is a very real danger. The problem is even more critical with the nationwide trend of utilizing walking paths through quiet areas for these types of sporting activities.

As a result of the increasing popularity of walking paths, they have become quite crowded and when skaters are present, can be hazardous. Typically, skating is a fairly non-intrusive form of recreation and a person on a walking path is often unaware that someone else is quickly approaching from behind. As a result, the person who is attempting to overtake the slower person will often yell, startling the other path user and sometimes doing more harm than good.

Therefore, there is a need for a warning device which, when in a quiet area such as a walking path can be heard at an acceptable distance and which is not as disruptive as the actual skater yelling at the person whom they are trying to pass. Further, there is a need to provide a simple low-cost warning device that the "skater" can use to forewarn someone who may be in danger of being a victim of a collision.

The subject invention herein solves all of these problems in a new and unique manner which has not been part of the art previously. Some related patents are described below:

U.S. Pat. No. 5,075,671 issued to R. Livingston on Dec. 24, 1991

This patent is directed towards a personal alarm system. The personal alarm apparatus includes a case having first and second ends, a radial or curved side and a flat side. The second end of the case includes a horn/valve combination and cone surrounded by a protective screen or cage. Affixed to the first narrow side portion of the case is a strap, while the second narrow side portion of the case has incorporated therein a retainer bracket with a tumbler type, three or four number combination locking mechanism. The strap may be comprised of a solid vinyl or webbed polyester cotton, relatively flat strip of sufficient length to snugly engage the wrist of the user of the device. The alarm system is initiated by applying pressure to the push-button, wherein the pressure is translated to the valve/horn member, which initiates the horn.

U.S. Pat. No. 4,635,516 issued to G. Giannini on Jan. 13, 1987

This patent is directed towards a tone generating glove and associated switches. The tone generating glove includes a plurality of switches, wherein each switch is positioned at each finger joint of the glove over each knuckle of the hand. The switches are connected by leads to a tone generating circuit whereby the tone generating circuit is connected to an amplifier, which drives a speaker.

U.S. Pat. No. 5,168,5756 issued to E. Krent, et al. on Dec. 8, 1992

This patent is directed towards a body protective device comprising a wrist guard designed to slip over the hand and onto the wrist, composed of modules having a relatively small intermodular membrane. A watch or other time keeping device and/or a compass can be integrated into the upper surface of the protective wrist guard. Additionally, a rigid cap is affixed to the upper surfaces of the modules which are designed to provide abrasion resistance.

U.S. Pat. No. 3,941,081 issued to Y. Nakamura on Mar. 2, 1976

This patent is directed toward an alarm for a bicycle. The alarm for the bicycle comprises a trumpet-like cylindrical body made of a material such as a plastic or the like, a mounting piece receptacle bed formed integral with the trumpet-like cylindrical body, a vocal member fixedly encased inwardly of a base portion in the cylindrical body, a bellow-like air blower bag, a cover member and a mounting piece disposed opposite the mounting piece receptacle bed and secured to a handle or the like of the bicycle through screws.

U.S. Pat. No. 3,638,011 issued to M. Bain, et al., on Jan. 25, 1972

This patent is directed towards a hand glove and light signal attachment. The combination hand glove and electric light signal unit comprises a fabric glove unit which includes a hand and finger portion and a wrist portion. The combination hand glove and electric light signal unit includes a water-resistant flexible rubber or like layer of the hand and finger portion of the glove and houses a small electric signal lamp which is suitably mounted in the housing.

While the basic concepts presented in the aforementioned patents are desirable, the apparatus employed by each to produce warning signals from a handheld device are mechanically far too complicated to render them as an inexpensive means of achieving a device for preventing accidentally colliding with bystanders while involved in certain sport activities such as roller blading, roller-skating and the like.

SUMMARY OF THE INVENTION

A handheld device used by skaters and the like for warning pedestrian traffic, as set forth in the present invention comprises an air bladder attached to a strap that is secured to the palm of the hand in such a way that when the user simply squeezes the bladder firmly, a loud honking sound is emitted. The sound is similar to that of bicycle horns currently in use. The sound is created by air passing through a disk containing a small vibrating reed that is housed on the posterior side of the air bladder.

In accordance with one embodiment of the present invention, the air bladder is essentially a generally tubular-shaped bladder that has a strap either attached or integrally molded so it can be adjusted to fit snugly around the palm area of the hand. The tubular-shaped bladder is configured to be suitable for either right or left handed operation. The adjustment of the strap may be accomplished by positioning the attachment portion of the strap to the interior end of the bladder by means of any method commonly applied in the art, i.e., Velcro®, snap-fit holes, etc.

Another object of the present invention is to provide a bell-shaped end surrounding the disk containing the vibrating reed housed on the posterior side of the bladder to further amplify the sound to be emitted.

Yet, still another object of the present invention is to have a handheld device that may be used as a promotional giveaway item by fast food restaurants or skate rental facilities wherein the handheld device has some beneficial effect on potential liability related to accidental collisions.

Still, yet another object of the present invention is to provide a handheld warning device which also incorporates a palm protection pad to minimize injury to the hand in the event the skater falls down. In accordance with the present invention, this may be achieved by shaping the air bladder in such a way that it conforms generally to the shape of the hand.

Still, yet another object of the present invention is to have the air bladder positioned in the hand so as to offer a cushioned effect during a fall, but also shaped to allow an air passage between the thumb and index finger where the sound disc is located so as to aim the sound generally forward.

Yet another object of the present invention is to have a handheld warning device shaped as a glove less the fingers that attaches to an air bladder in place of a strap which allows further protection from injury while allowing the safety feature of a warning device.

Accordingly, it is an object of the present invention to provide a safe, effective, yet inexpensive and relatively mechanically unsophisticated handheld warning device, which is rugged yet lightweight, easily carried and used.

BRIEF DESCRIPTION OF THE DRAWINGS

The above, as well as other, advantages of the present invention will become readily apparent to those skilled in the art from the following detailed descriptions of the preferred embodiment when considered in light of the accompanying drawings in which.

DESCRIPTION OF THE PREFERRED EMBODIMENTS

Figure 1A:
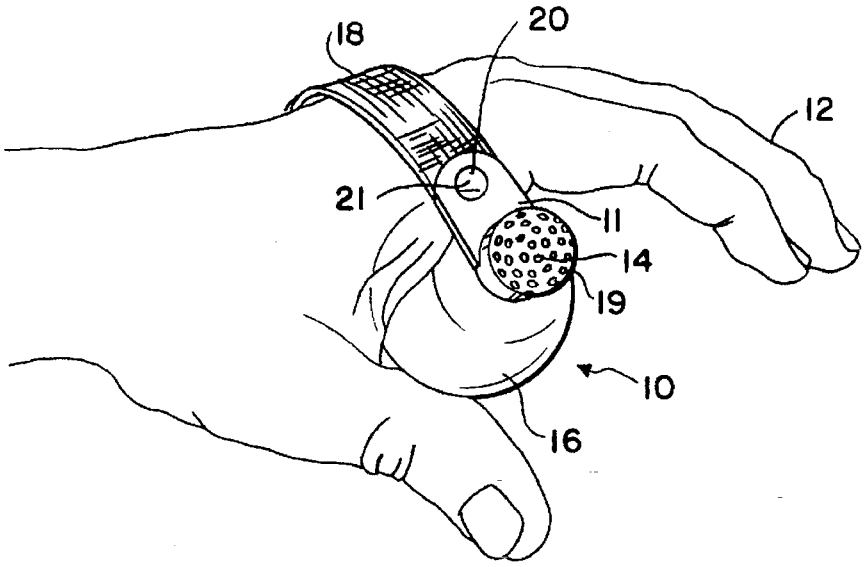
FIG. 1A is a perspective view of one embodiment of the handheld warning device of the present invention.
Figure 1B:
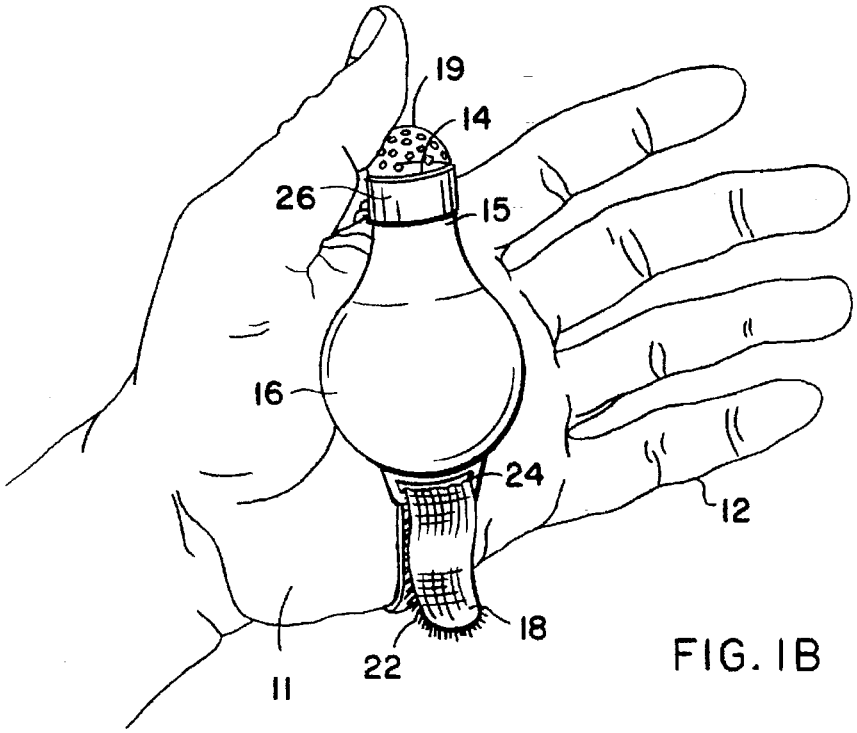
FIG. 1B is another perspective view of the handheld warning device shown in FIG. 1A.

Referring now to the drawings wherein like reference numerals refer to like and corresponding parts throughout, the handheld warning device is generally indicated by numeral 10. Referring now to the drawings, and more particularly to FIGS. 1A–1B thereof, the handheld warning device 10, according to one embodiment of the present invention comprises a generally tubular shaped air bladder 16 that has a strap 18 either attached or integrally molded so that it can be adjusted to fit snugly around the palm area 11 of the user's hand 12. Housed on the posterior side 15 of the tubular shaped air bladder 16 is a vibrating reed 14 for producing sound, as will be more fully explained below.

Referring once again to FIGS. 1A and 1B, on the posterior end 15 of the generally tubular-shaped bladder 16, there is attached a disc 26 containing a small reed housed within a bell-shaped casing 19. The disc additionally defines a tab portion 11 defining a hole 21 for receiving a rivet 20 that attaches onto the strap 18 out of one end. On the opposite end of air bladder 16 is an aperture member 24 for receiving the opposite end of strap 18. As shown in FIG. 1B, at the end of strap 18 are VELCRO® means 22 for adjustment of the strap to fit snugly around the hand 12 of the user.

In use, the air bladder 16 is secured to the palm of the hand 12 in such a way that when the user simply squeezes the air bladder 16 firmly, air is passed through the vibrating reed 14 that is housed on the posterior side 15 of air bladder 16 thereby emitting a loud honking sound. The sound is similar to that of bicycle horns currently in use.

Figure 2A:
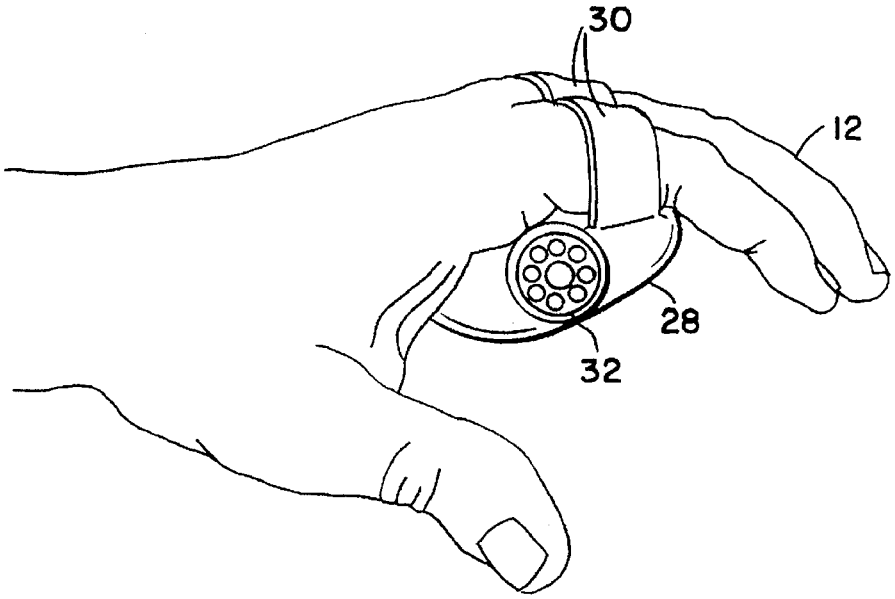
FIG. 2A is a perspective view of another embodiment of the handheld warning device of the present invention.
Figure 2B:
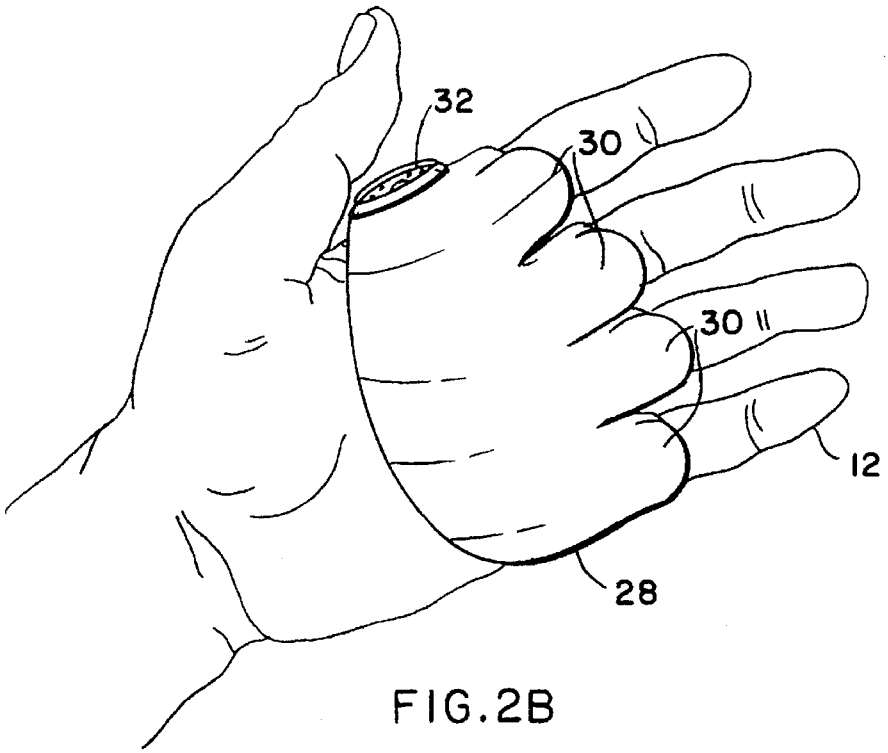
FIG. 2B is another perspective view of the handheld warning device shown in FIG. 2A.

Referring now to FIGS. 2A and 2B, in a second embodiment of the invention, the air bladder 28 is shaped to conform to the fingers of the user's hand 12, wherein the attachment means comprises a plurality of finger straps 30 that the user may slip his fingers through, thereby engaging the air bladder 28. In this embodiment, the air bladder 28 is integrally molded with the finger straps 30. On the posterior end of air bladder 28 is housed the vibrating reed 32 for once again producing a loud honking sound when the user closes the palm and the tips of the fingers of the hand 12.

Figure 3A:
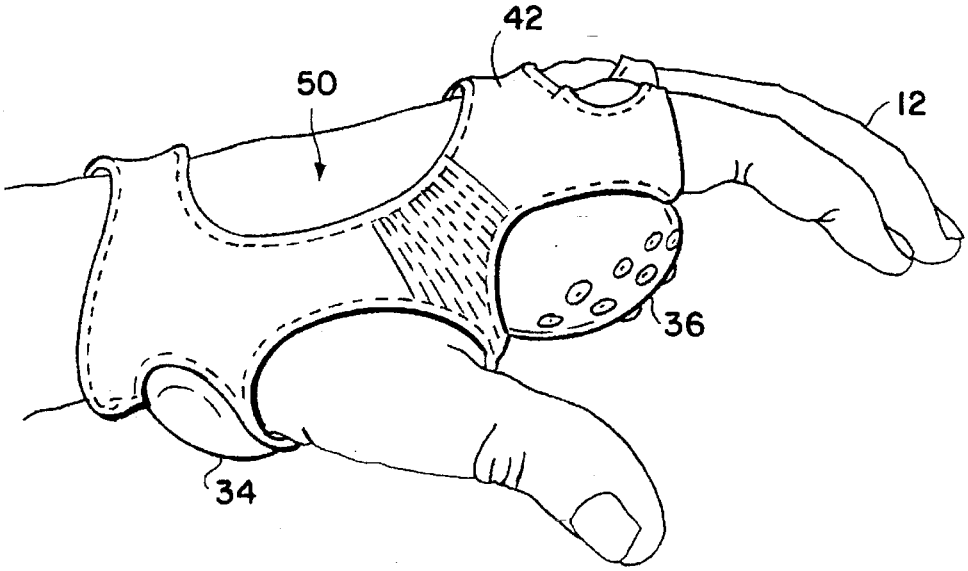
FIG. 3A is a perspective view of another embodiment of the handheld warning device of the present invention.
Figure 3B:
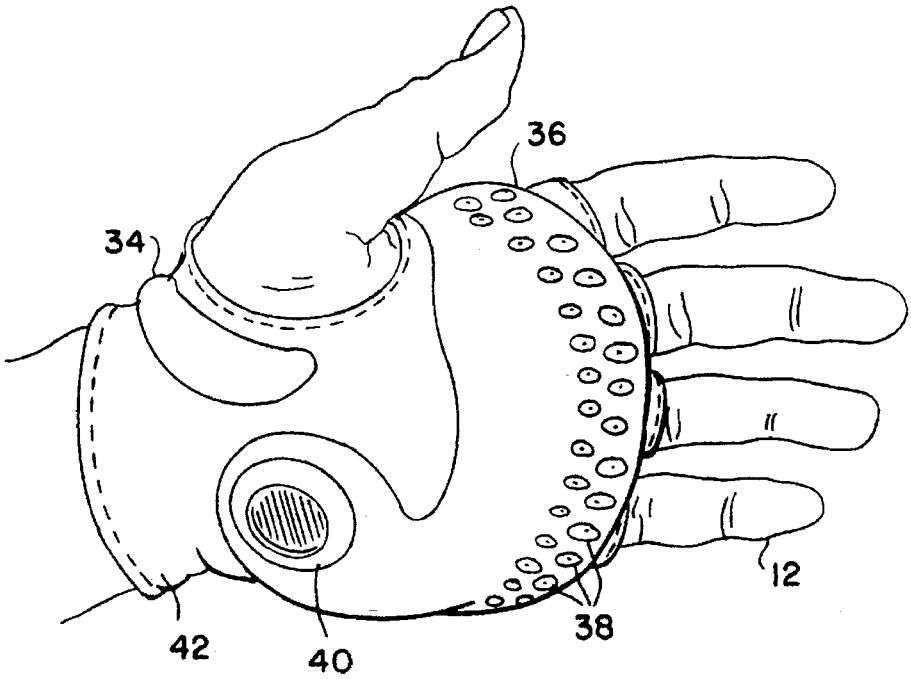
FIG. 3B is another perspective view of the handheld warning device shown in FIG. 3A.

Referring now to FIGS. 3A and 3B, in the third embodiment of the invention, the air bladder 36 is shaped as a palm protection pad to minimize injury during a fall. In this embodiment, the attachment means comprises a partial glove member 42 having an upper open recess 50 and open areas for the knuckle region of the hand 12 and may be made from an open weave fabric. The air bladder 36 is shaped in such a way that it conforms generally to the shape of the user's palm having the vibrating reed or wire mesh horn 40 located near the bottom portion of the hand 12, such that when the fingers are compressed, air is forced through the horn and once again the warning sound is emitted. Additionally, along the upper edge of the air bladder 36 are a plurality of ridges or wear bumps 38 molded as part of the air bladder 36 to offer additional protection in the event the skater should fall.

Figure 4A:
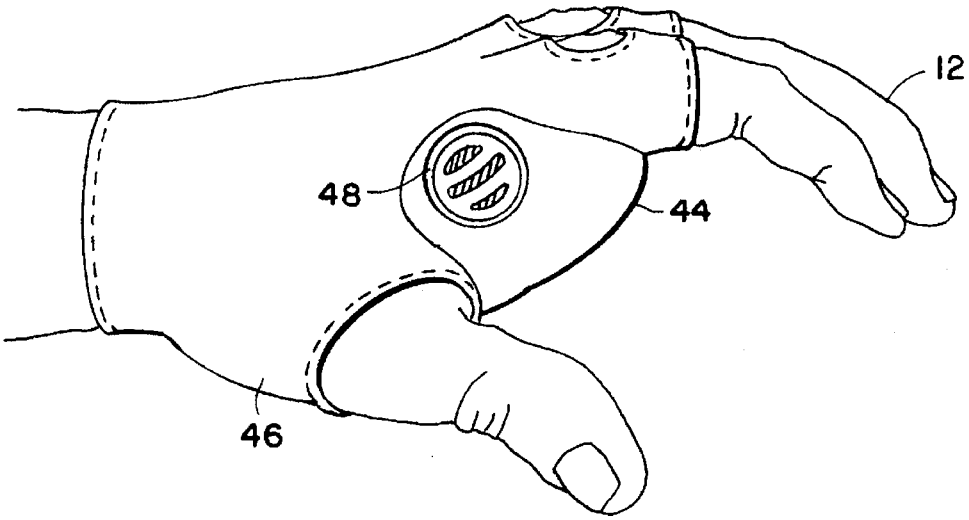
FIG. 4A is a perspective view of another embodiment of the handheld warning device of the present invention.
Figure 4B:
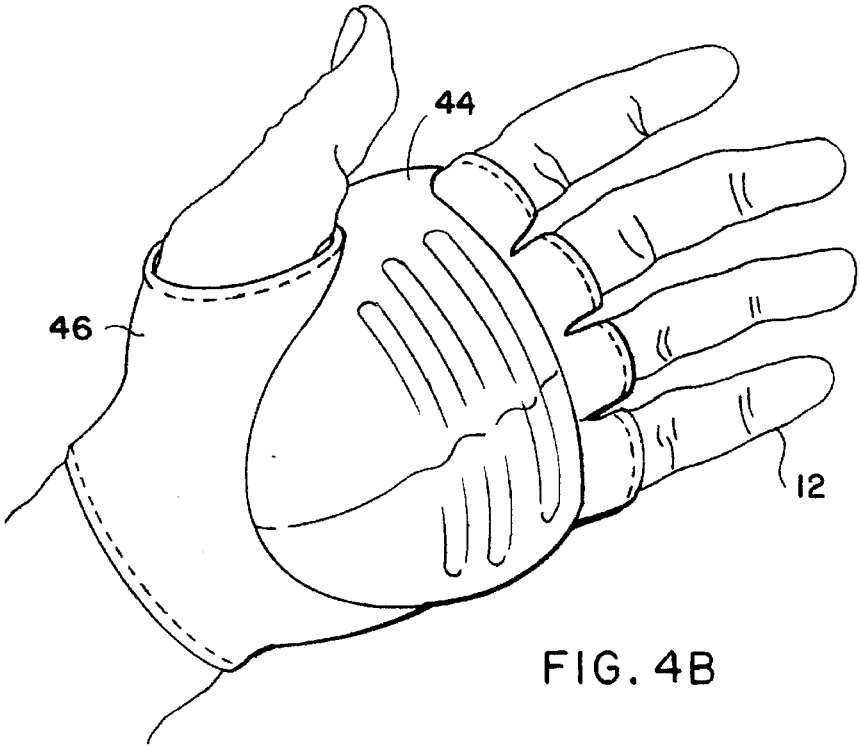
FIG. 4B is another perspective view of the handheld warning device shown in FIG. 4A.

Turning now to FIGS. 4A and 4B, in a fourth embodiment, the air bladder 44 is shaped similar to the third embodiment with the air passage located between the thumb and index fingers, positioning the reed or horn 48 so as to aim the sound generally forward. In this embodiment, the air bladder 44 is once again integral with a glove member 46 and positioned so as to offer a cushioning effect in case the skater falls.

Figure 5A:
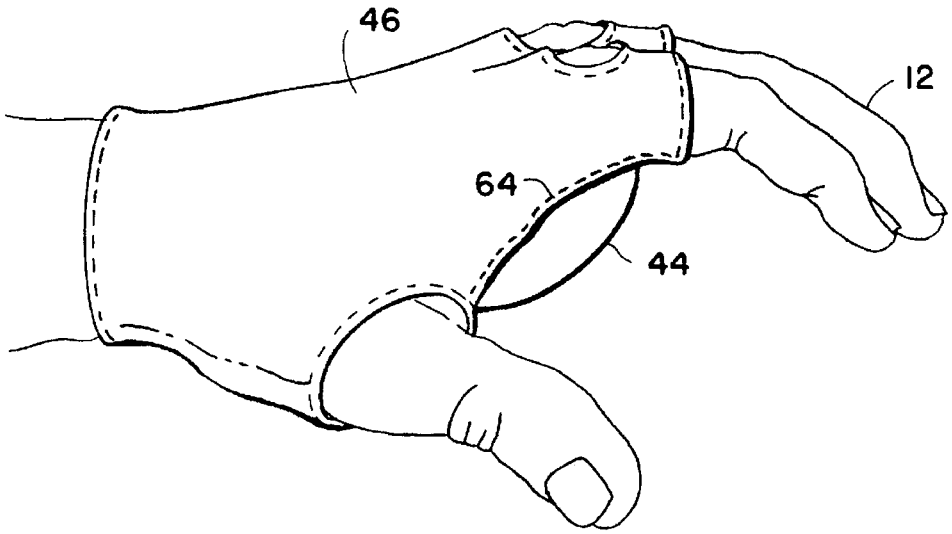
FIG. 5A is a perspective view of another embodiment of the handheld warning device of the present invention.
Figure 5B:
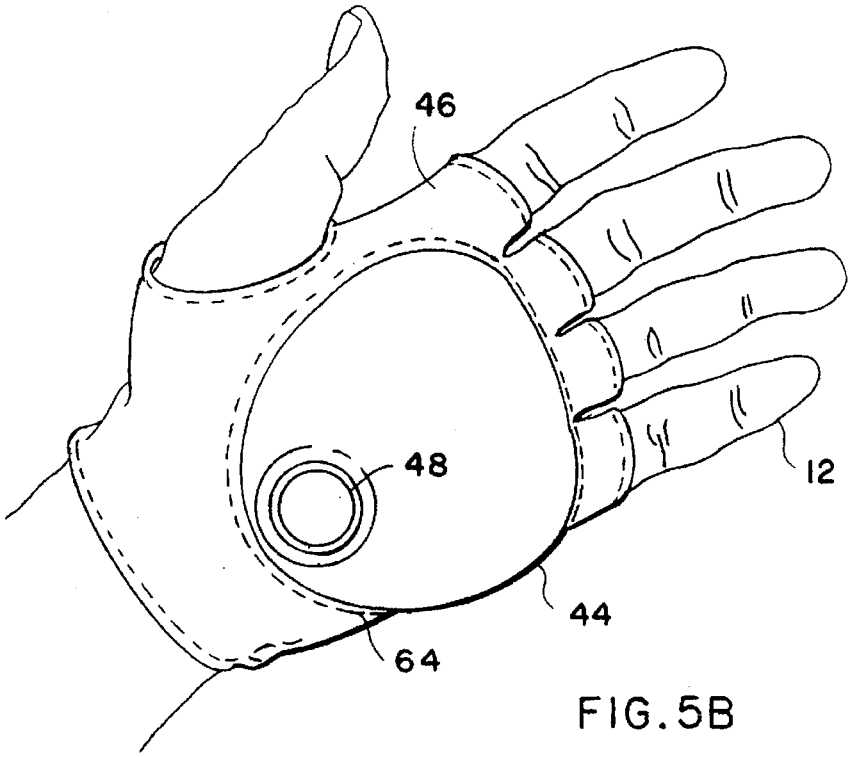
FIG. 5B is another perspective view of the handheld warning device shown in FIG. 5A.

In a fifth embodiment, the air bladder as shown in FIGS. 3A and 3B may be stitched to a conventional fabric glove member 64 used in sporting events, wherein the air passage is located substantially below the thumb and index fingers for location of the sound disc 48, as shown in FIGS. 5A and 5B. Additionally, the air bladder may be made from rubber or any similar polyurethane material.

Figure 6A:
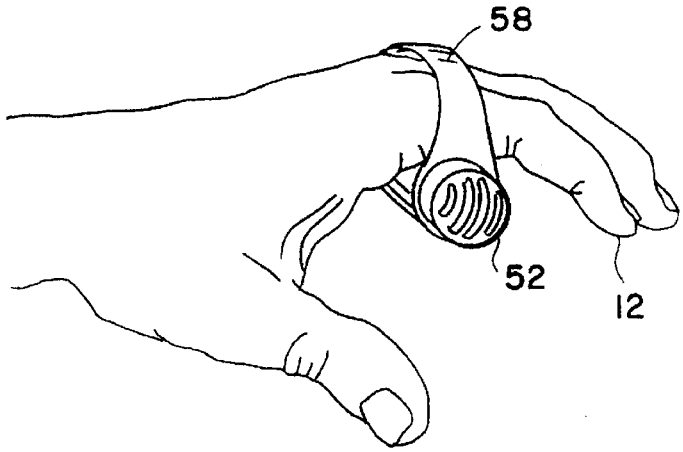
FIG. 6A is a perspective view of another embodiment of the handheld warning device of the present invention.
Figure 6B:
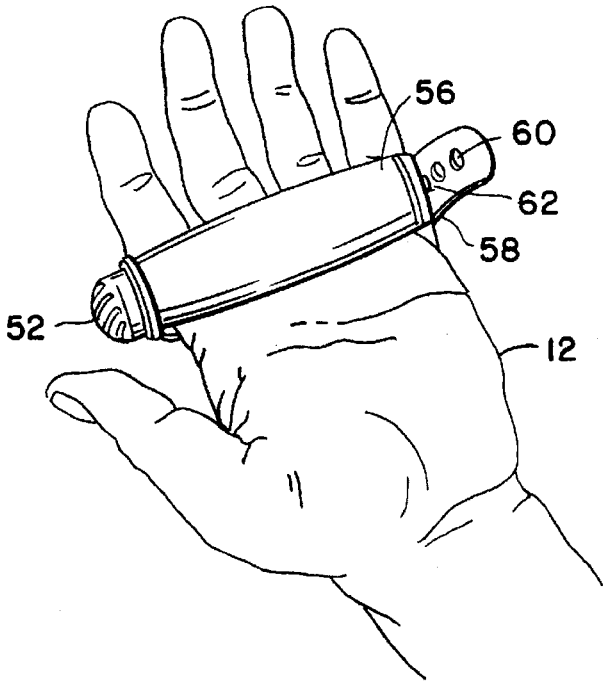
FIG. 6B is another perspective view of the handheld warning device shown in FIG. 6A.
Figure 6C:
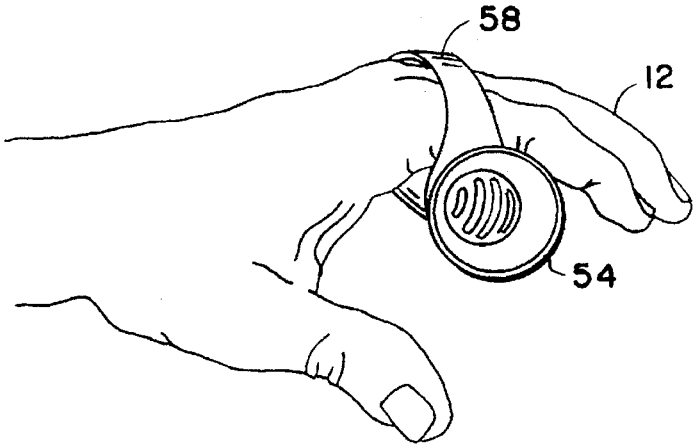
FIG. 6C is a perspective view of another embodiment of the handheld warning device shown in FIG. 6A.

In the sixth embodiment, shown in FIGS. 6A and 6B, the handheld device 10 comprises a cylindrical tubular member 56, having at one end the sound disc 52 and a strap 58 either attached or integrally molded with a snap fit hole 60 for snapping onto the other end 62 of strap 58. In this embodiment, the handheld device 10 may be used as a promotional giveaway item by fast food restaurants or skate rental facilities, wherein the handheld device 10 has some beneficial effect on potential liability related to accidental collisions. As shown in FIG. 6C, the handheld device 10 of FIGS. 6A and 6B may also incorporate a bell-shaped end 54 over the sound disc 52 employed at the exit of the air bladder 56 to further amplify the sound to be emitted.

There has been described and illustrated herein, an improved handheld warning device which may be used by skaters along beaches, streets and other areas where pedestrian traffic is present as a means for preventing accidental collision with pedestrians on the pathway. While particular embodiments of the invention have been described, it is not intended that the invention be limited exactly thereto, as it is intended that the invention be as broad in scope as the art will permit.

The foregoing description and drawings will suggest other embodiments and variations within the scope of the claims to those skilled in the art, all of which are intended to be included in the spirit of the invention as herein set forth.

What is claimed is:

1. A warning device held against the palm of a user's hand comprising:

indicating means for producing a sound having an inflatable bladder means disposed along the palm of the hand for providing air pressure to said indicating means; and attachment means for securing said inflatable bladder means and said indicating means to the user's hand whereby when the user closes his hand said inflatable bladder means provides air pressure to said indicating means thereby producing a warning sound to oncoming traffic;

wherein said inflatable bladder means comprises a generally tubular shaped air bladder;

wherein said indicating means comprises a disk containing a small reed housed within a bell-shaped casing attached at a posterior end of said generally tubular shaped air bladder; and wherein said attachment means comprises a strap that is fixedly engaged to said disk at one end of said generally tubular shaped air bladder and is received through an aperture member defined at an opposite end of said tubular shaped air bladder wherein said strap having VELCRO® means for adjustment of said strap to fit snugly around the hand of the user.

2. A warning device held against the palm of a user's hand comprising:

indicating means for producing a sound having an inflatable bladder means disposed along the palm of the hand for providing air pressure to said indicating means; and attachment means for securing said inflatable bladder means and said indicating means to the user's hand whereby when the user closes his hand said inflatable bladder means provides air pressure to said indicating means thereby producing a warning sound to oncoming traffic;

wherein said attachment means and said inflatable bladder means comprises an air bladder having integrally molded a plurality of finger straps wherein the user slips his fingers through thereby engaging said air bladder.

3. A warning device held against the palm of a user's hand comprising:

indicating means for producing a sound having an inflatable bladder means disposed along the palm of the hand for providing air pressure to said indicating means; and attachment means for securing said inflatable bladder means and said indicating means to the user's hand whereby when the user closes his hand said inflatable bladder means provides air pressure to said indicating means thereby producing a warning sound to oncoming traffic;

wherein said attachment means comprises a partial glove member and said inflatable bladder means is an air bladder shaped as a palm protection pad to minimize injury during a fall.

4. A warning device according to claim 3, wherein said indicating means comprises a wire mesh horn located at a bottom portion of said air bladder.

5. A warning device according to claim 3, wherein said air bladder defines a plurality of ridges along an upper edge whereby said plurality of ridges offer additional protection in the event the user should fall.

6. A warning device held against the palm of a user's hand comprising:

indicating means for producing a sound having an inflatable bladder means disposed along the palm of the hand for providing air pressure to said indicating means; and attachment means for securing said inflatable bladder means and said indicating means to the user's hand whereby when the user closes his hand said inflatable bladder means provides air pressure to said indicating means thereby producing a warning sound to oncoming traffic;

wherein said attachment means comprises a conventional fabric glove member used in sporting events and said inflatable bladder means comprises an air bladder wherein said air bladder is stitched to said conventional fabric glove member.

7. A warning device according to claim 6, wherein said indicating means comprises a sound disc housed within said conventional fabric glove member between thumb and index fingers whereby the location of said sound disc aims the sound generally forward.

8. A warning device held against the palm of a user's hand comprising:

indicating means for producing a sound having an inflatable bladder means disposed along the palm of the hand for providing air pressure to said indicating means; and attachment means for securing said inflatable bladder means and said indicating means to the user's hand whereby when the user closes his hand said inflatable bladder means provides air pressure to said indicating means thereby producing a warning sound to oncoming traffic;

wherein said inflatable bladder means comprises a cylindrical tubular member and said indicating means comprises a sound disc located at a first end of said cylindrical tubular member and said attachment means comprises a strap connected to said first end of said cylindrical tubular member wherein said strap is adjustably connected to a second end of said cylindrical tubular member.

9. A warning device according to claim 8, wherein incorporated over said sound disc is a bell-shaped end whereby said bell-shaped end further amplifies the sound to be emitted.

* * * * *